US006325860B1

(12) United States Patent
Coleman, III

(10) Patent No.: US 6,325,860 B1
(45) Date of Patent: Dec. 4, 2001

(54) METHOD OF PROVIDING FLAVORFUL AND AROMATIC COMPOUNDS IN ABSENCE OF REDUCING SUGARS

(75) Inventor: William Monroe Coleman, III, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/504,161

(22) Filed: Feb. 15, 2000

(51) Int. Cl.[7] ..... A24B 15/30

(52) U.S. Cl. ..... 131/276; 131/274; 131/352; 544/336; 544/408; 426/466; 426/468

(58) Field of Search ..... 131/276, 274, 131/352, 290; 544/336, 408; 426/466, 468

(56) References Cited

U.S. PATENT DOCUMENTS

| | | |
|---|---|---|
| Re. 32,095 | 3/1986 | Wu et al. . |
| 3,478,015 | 11/1969 | Onishi et al. . |
| 3,722,516 | 3/1973 | Suwa et al. . |
| 3,920,026 | 11/1975 | Warfield et al. . |
| 4,306,577 | 12/1981 | Wu et al. . |
| 4,407,307 | 10/1983 | Gaisch et al. . |
| 4,516,590 | 5/1985 | Teng . |
| 4,537,204 | 8/1985 | Gaisch et al. . |
| 5,413,122 | 5/1995 | Shu et al. . |

OTHER PUBLICATIONS

Factors Affecting the Formation of Pyrazine Compounds in Sugar–Amine Reactions, P.E. Koehler et al., J. Agr. Food Chem., vol. 18, No. 5, 1970, pp. 895–898.

Formation of Pyrazine Compounds in Sugar–Amino Acid Model Systems, P. E. Koehler et al., J. Agr. Food Chem., vol. 17, No. 2, Mar–Apr. 1969, pp. 393–396.

Parameter Effects on the Thermal Reaction of Cystine and 2, 5–Dimethyl–4–hydroxy–3 (2H)–furanone, C. Shu et al., *Thermal Generation of Aromas*, Chapter 21, 1989, *American Chemical Society*, pp. 229–241.

The Variety of Odors Produced in Maillard Model Systems and How They Are Influenced by Reaction Conditions, M.J. Lane et al., Maillard Reactions, Chapter 9, 1983, American Chemical Society, pp. 141–158.

*Primary Examiner*—Stanley S. Silverman
*Assistant Examiner*—M. Halpern

(57) ABSTRACT

A method for making highly potent flavorful and aromatic substances for use in a smoking article is disclosed. The method includes providing a mixture containing hydroxyketone, a Strecker aldehyde, and ammonium hydroxide, and subjecting the mixture to heat treatment for a time and under conditions sufficient to provide a flavorful and aromatic composition.

20 Claims, 9 Drawing Sheets

FIGURE 1 PYRAZINE YIELD IN MICROWAVE HEAT-TREATED FORMULATIONS WITH HFCS AND ALDEHYDES
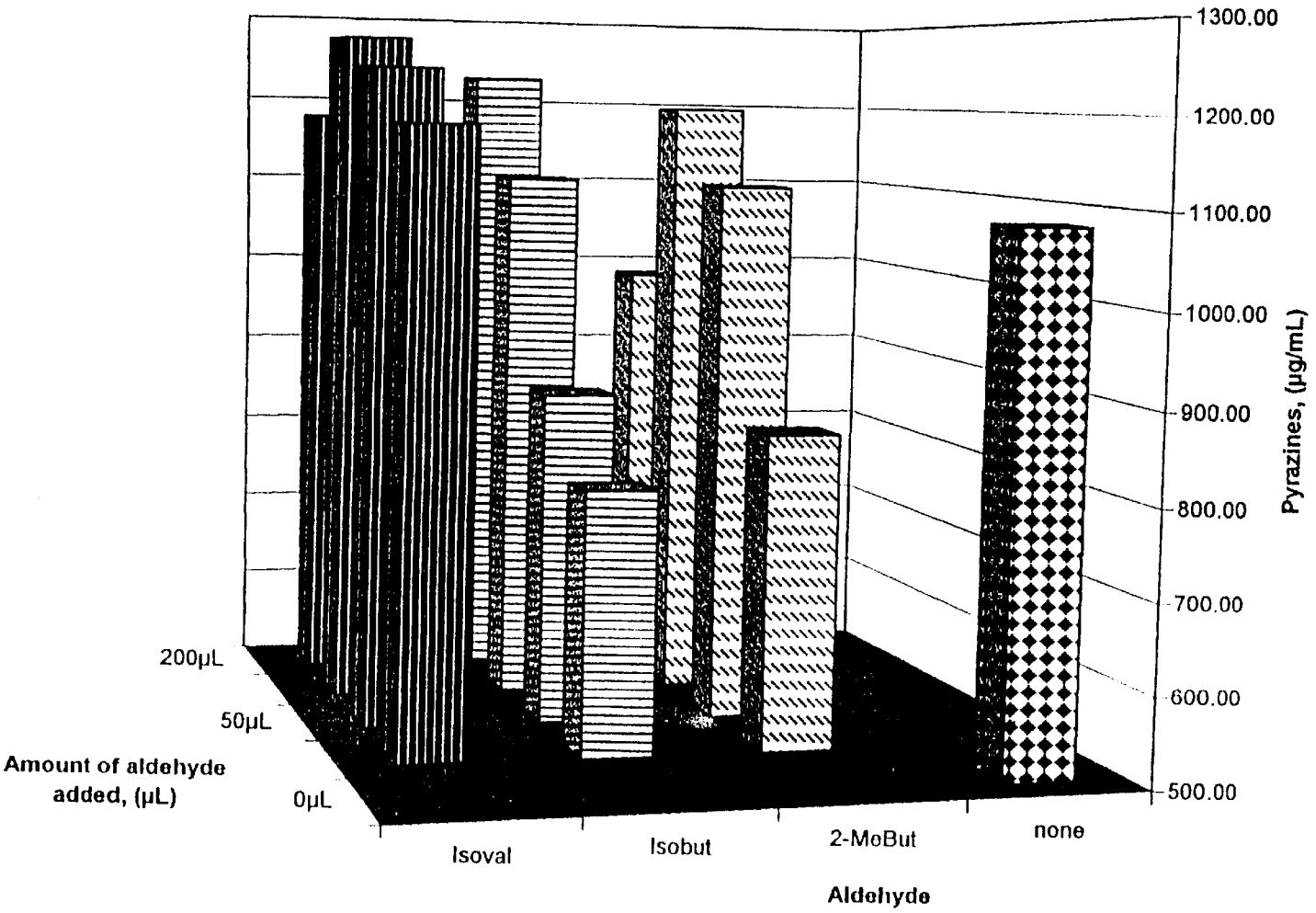

FIGURE 2 Percent Branched Pyrazines IN MICROWAVE HEAT-TREATED FORMULATIONS with HFCS and Aldehydes
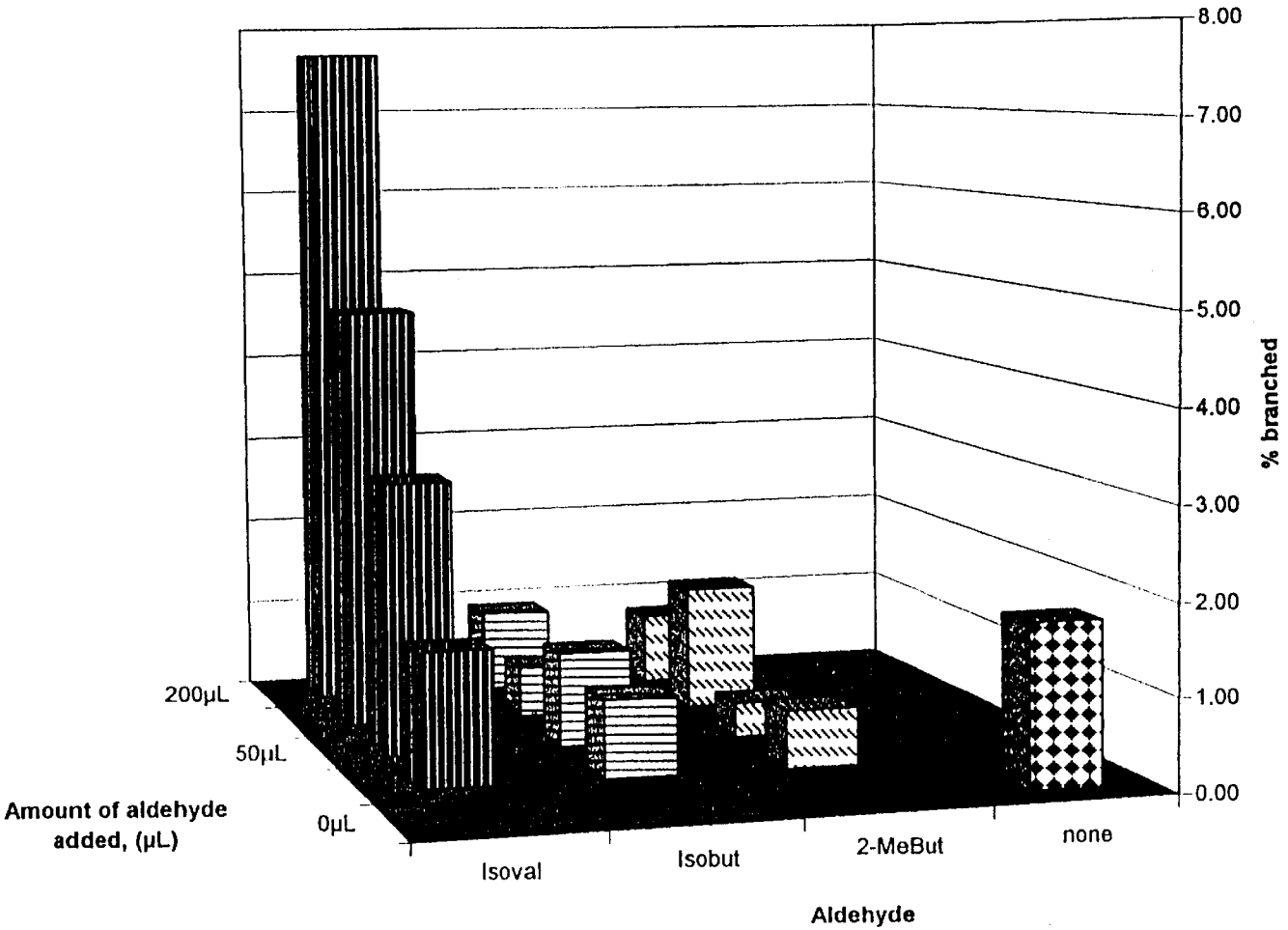

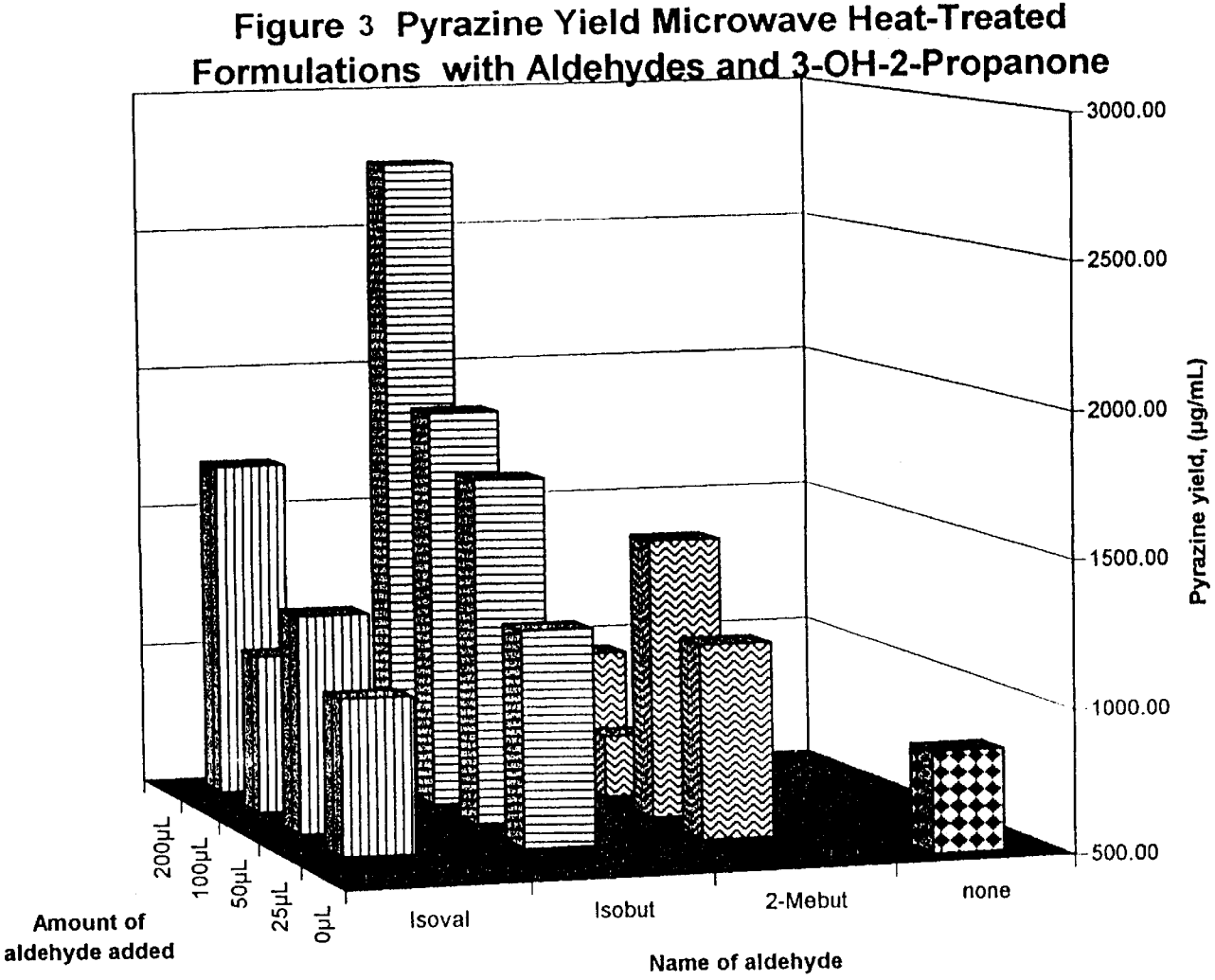
Figure 3 Pyrazine Yield Microwave Heat-Treated Formulations with Aldehydes and 3-OH-2-Propanone FIGURE 4 %BRANCHED PYRAZINES IN MICROWAVE HEAT-TREATED FORMULATIONS WITH ALDEHYDES AND 3-OH-2-PROPANONE
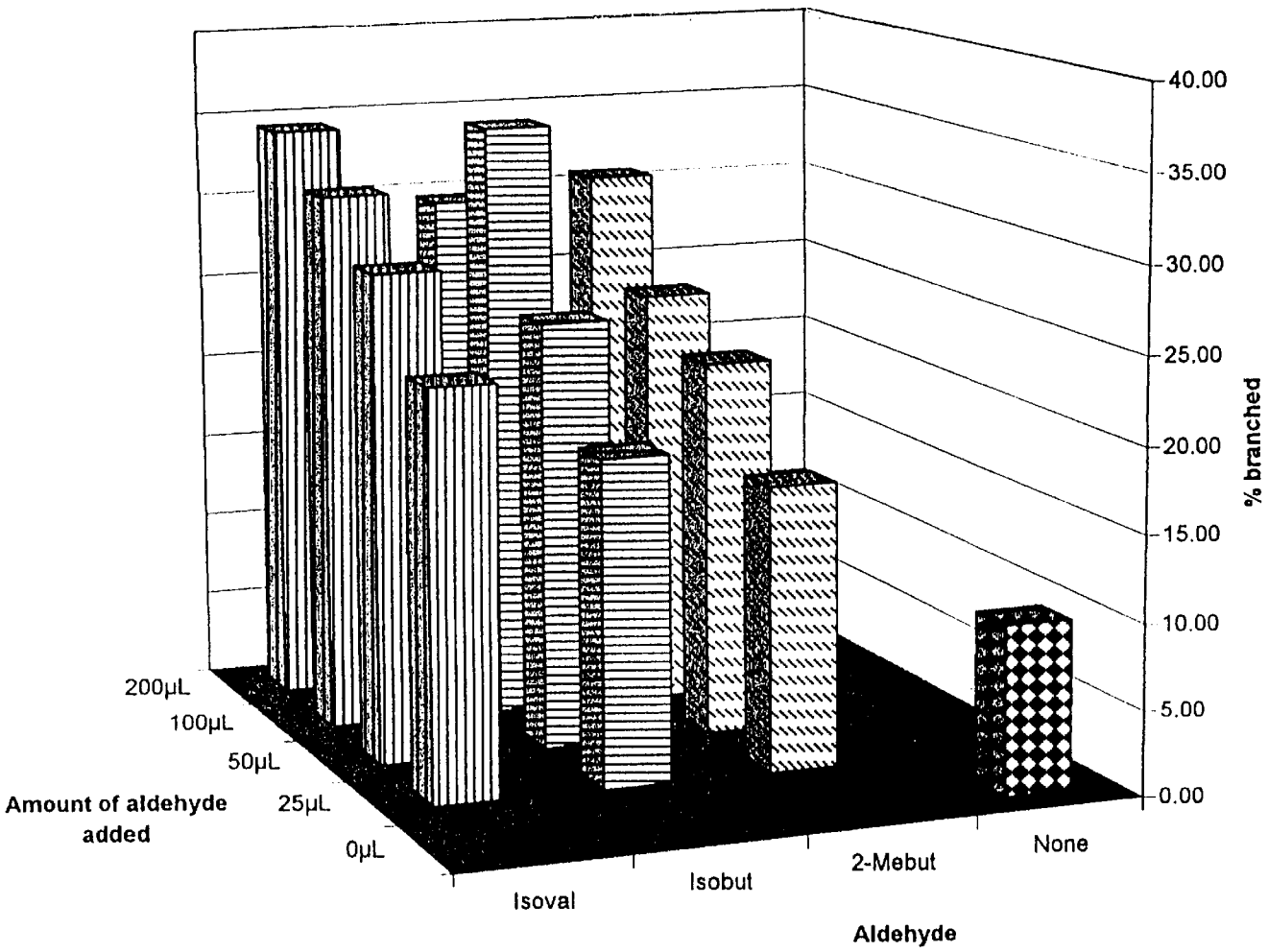

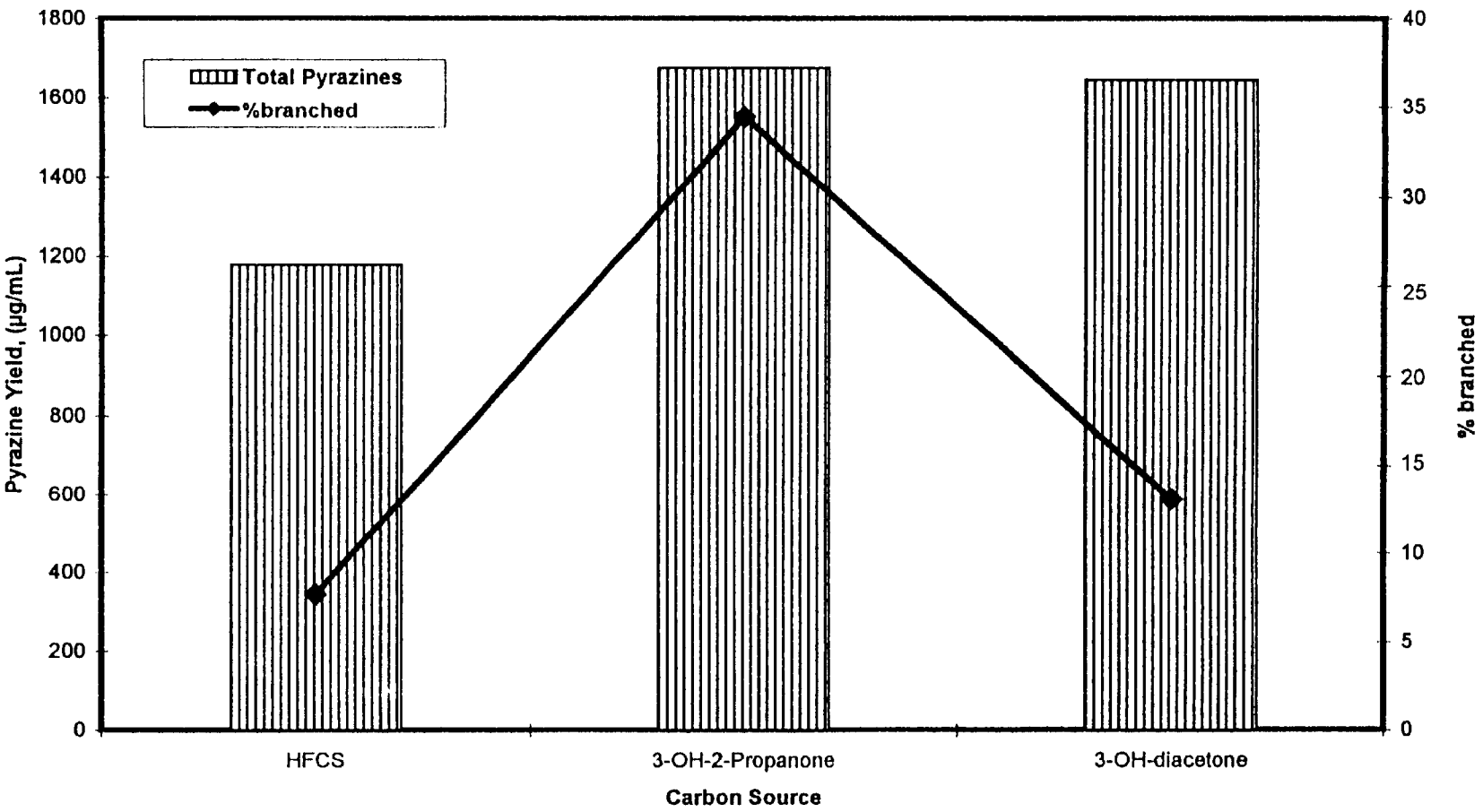
FIGURE 5 Total and %Branched Pyrazines in Formulations with Different Carbon Sources

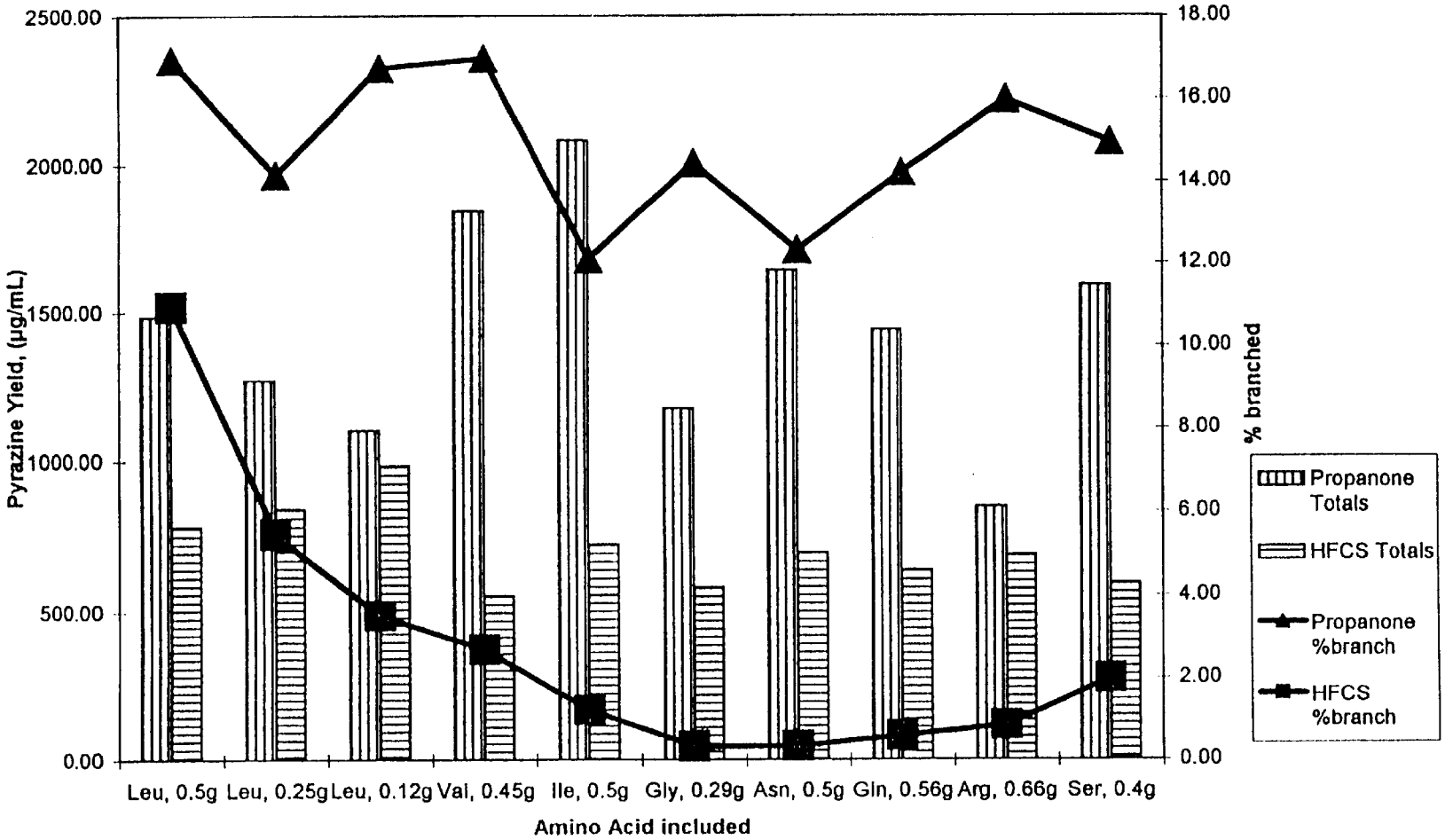
Figure 6 Pyrazine Yield and Percent Branched Pyrazines in Microwave Prepared Formulations with Amino Acids

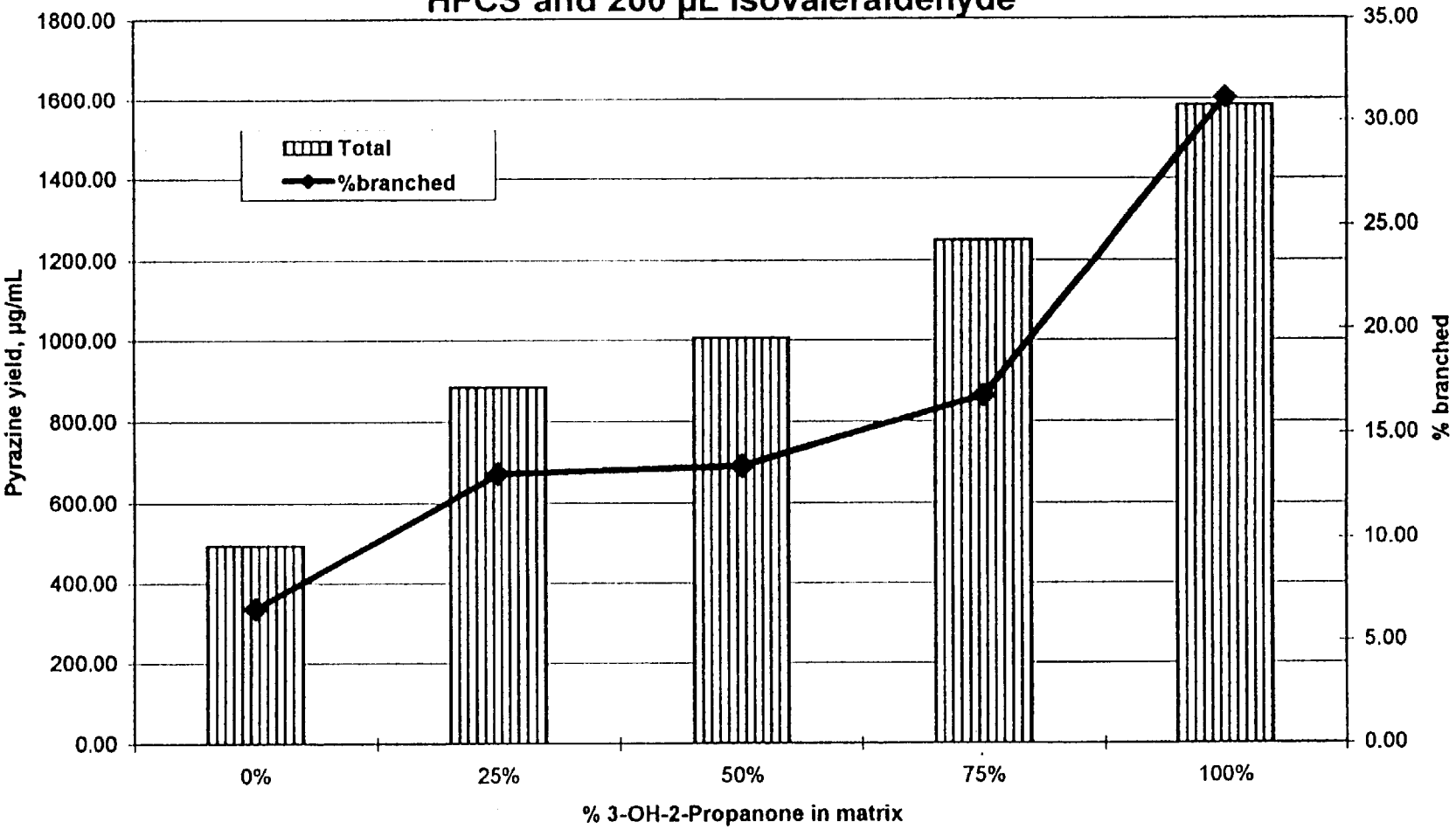
Figure 7 Total Yield and Percent Branched Pyrazines Formed in Microwave Reactions Containing a Mixture of 3-OH-2-Propanone, HFCS and 200 µL Isovaleraldehyde

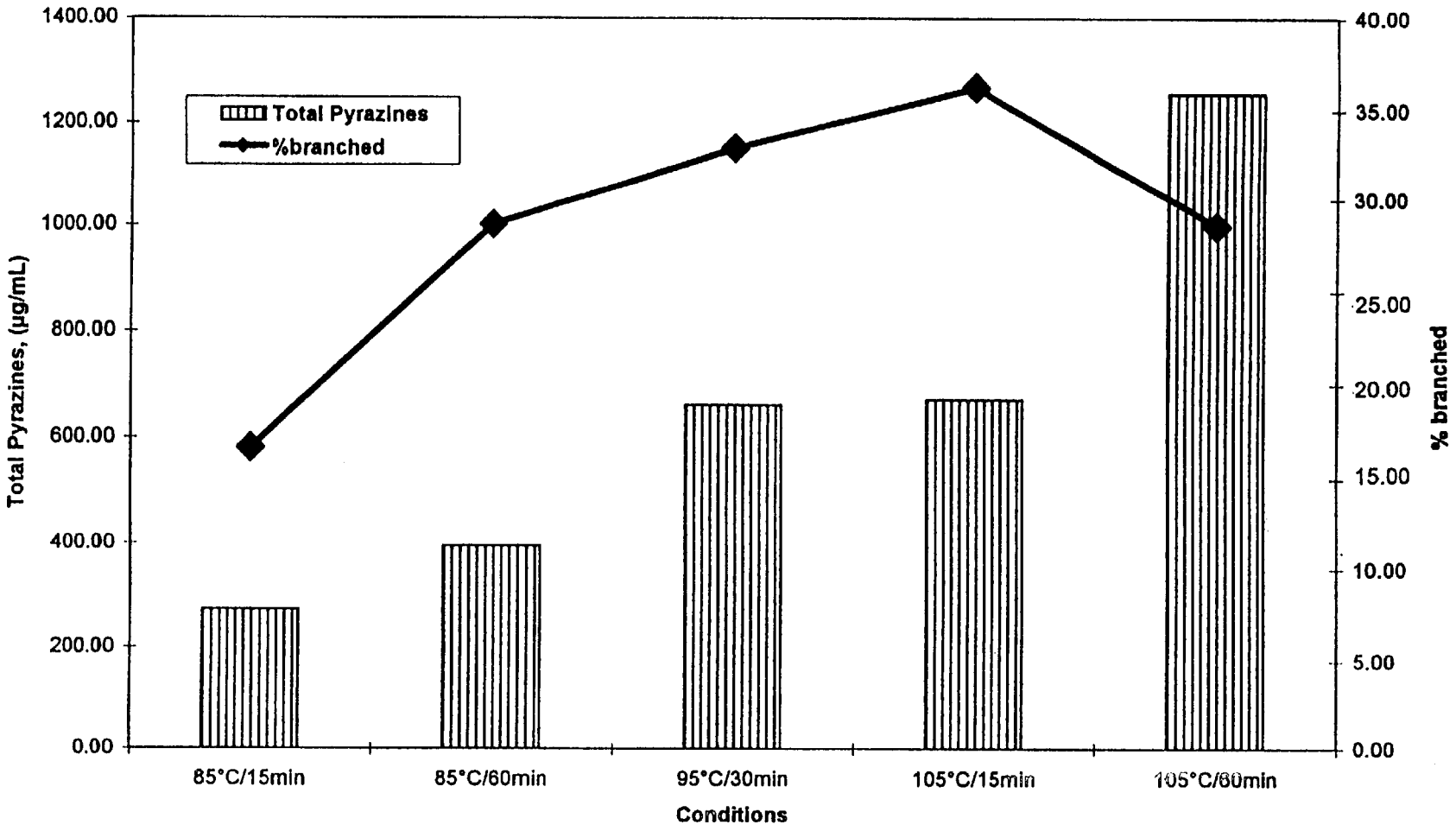
FIGURE 8 Total and % Branched Pyrazines in Formulations w/ 50µL Isoval and 100% Propanone at Various Conditions

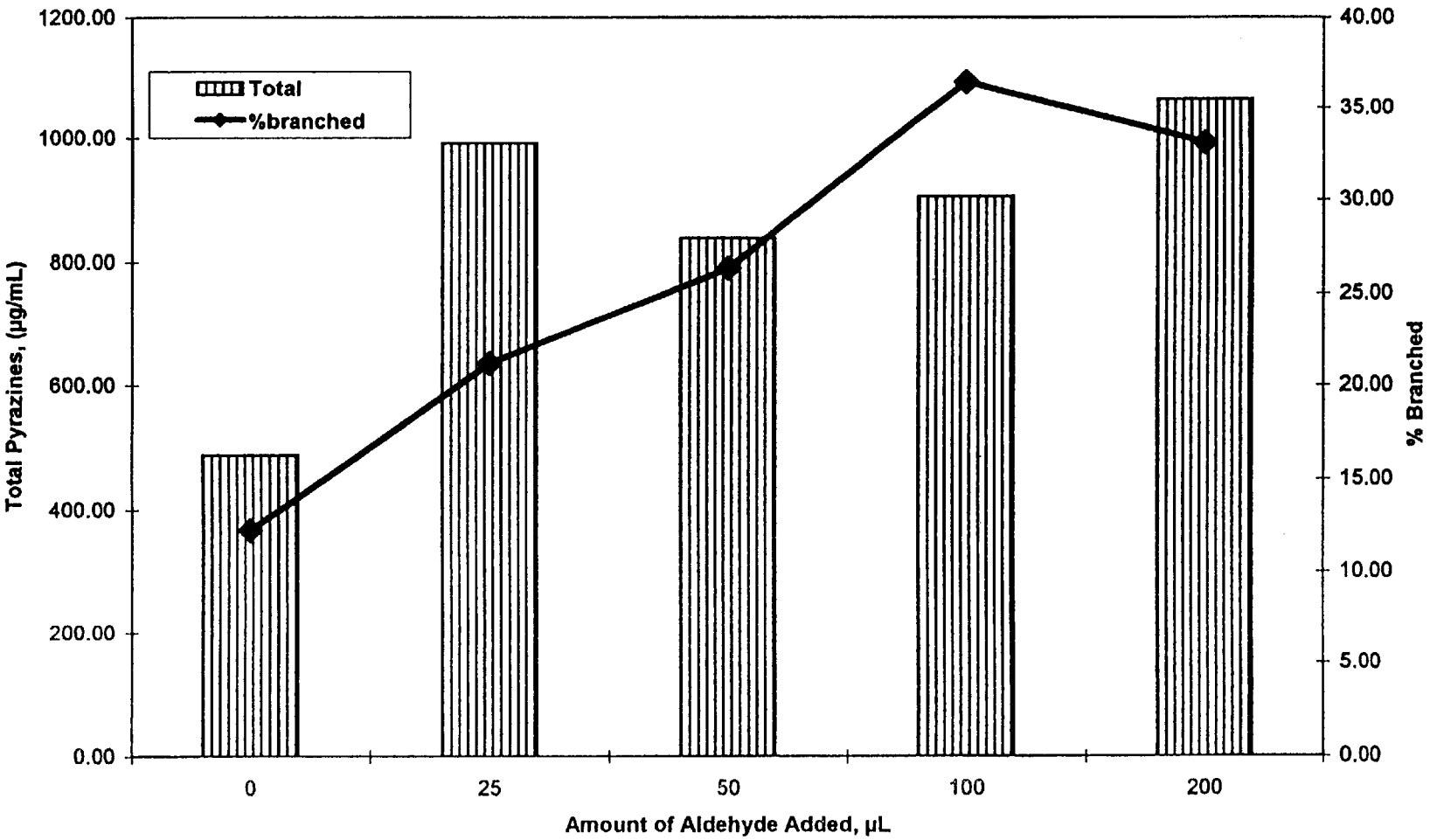
FIGURE 9 TOTAL AND % BRANCHED PYRAZINES IN MICROWAVE PREPARED FORMULATIONS WITH 3-OH-2-PROPANONE (0.028 moles)/NH4OH(0.014moles)/ISOVALERALDEHYDE 105°C/60min

METHOD OF PROVIDING FLAVORFUL AND AROMATIC COMPOUNDS IN ABSENCE OF REDUCING SUGARS

FIELD OF INVENTION

The present invention relates to smoking articles such as cigarettes, and in particular to processes for providing a flavorful and aromatic composition for use in smoking articles.

BACKGROUND OF THE INVENTION

Flavor and aroma are important characteristics of smoking articles. To improve the flavor and aroma in smoking articles, flavorful and aromatic substances, including various natural extracts, have been included in smoking articles. For example, various processes for producing and using tobacco extracts, aroma oils and concentrates are proposed in the U.S. Pat. No. 3,136,321 to Davis; U.S. Pat. No. 3,316,919 to Green; U.S. Pat. No. 3,424,171 to Rooker; U.S. Pat. No. 4,421,126 to Gellatly and U.S. Pat. No. 4,506,682 to Mueller and European Patent Publication No. 338,831 to Clapp et al.

U.S. Pat. No. 5,413,122 discloses making a flavorful and aromatic composition from β-hydroxy α-amino acids by contacting the amino acids with a liquid having an aqueous character. The ratio of liquid to amino acid is 4:1 to 40:1. The mixture is subjected to heat treatment in an enclosed environment to react the amino acids and to thereby provide an aqueous solution of volatile pyrazine flavorants. The resulting aqueous extract containing flavorful pyrazines is then applied to smoking materials to provide flavor and aroma in the smoking articles.

It has also been proposed to react sugars with amino acids to produce desirable flavorants for smoking articles and foods. For example, U.S. Pat. No. 3,478,015 discloses heating a mixture of an amino acid and a sugar in the presence of a polyhydric alcohol and using the reaction product as a flavoring material.

U.S. Pat. No. 3,920,026 describes reacting the amino acid valine with a sugar, other hydroxycarbonyl compound, or dicarbonyl compound under heat treatment in a solvent such as glycerol or propylene glycol and at a temperature of about 100° C. to about 200° C. for about 0.5 to 5 hours. Optionally, a catalyst such as a flavanoid or hydroxyacid is included in the reaction. The reaction products can be used as flavorants in tobacco compositions.

U.S. Pat. No. 4,306,577 discloses the production of flavorants for smoking compositions by reacting reducing sugars and selected amino acids in the presence of ammonium hydroxide and optionally in the presence of an aldehyde in an essentially solvent-free system at a temperature range of 90° C. to 115° C. The selected amino acids are those that have at least two nitrogens such as glutamine, asparagine, lysine, and arginine.

Similarly, U.S. Pat. No. Re. 32,095 discloses reacting a reducing sugar with a source of ammonia in the presence of a trace amount of certain amino acids at a temperature in the range of about 90° C. to about 115° C. for about 5 to 15 minutes. The trace amino acids include aspartic acid, glutamic acid, asparagine, and glutamine. The weight ratio of sugar to amino acid is in the range of 200–300:1, and the weight ratio of sugar to ammonia source is about 5–15:1.

Although these and other materials can enhance the taste of tobacco products, because of the volatile nature of flavorant and aroma materials, they are often lost at least in part during cigarette manufacturing and packaging steps. Also quantities of the flavorant and aroma materials can diminish during the storage of the finished smoking articles and it is often necessary to increase the initial content of flavorants to compensate.

SUMMARY OF THE INVENTION

The present invention provides a method of providing flavorful and aromatic substances which includes heating a mixture comprising a hydroxyketone, a Strecker aldehyde, and ammonium hydroxide. The resultant composition of flavorful and aromatic substances from the reaction includes a substantial quantity of flavorful and aromatic pyrazines that are especially desirable in smoking articles for improving the flavor and aroma properties of the smoking articles. As compared to the conventional methods known in the art, the method of the present invention produces pyrazines at a significantly greater yield. Moreover, a much greater percentage of pyrazines have branched alkyl side chains. As a result, the flavorful and aromatic substances generated in the present invention exhibit decreased volatility in addition to a lower sensory threshold, i.e., powerful sensory attributes at very low concentrations. Thus, smaller quantities of the flavorant and aroma materials of the invention can be used in smoking articles to provide a significantly greater enhancement of flavor and aroma. At the same time, loss of the flavorants during manufacturing and storage of the smoking articles is minimal.

Preferably the hydroxyketones employed in the method of the invention are lower alkyl based hydroxyketones, i.e., compounds comprising 6 carbon atoms or less and containing only carbon, oxygen and hydrogen atoms. Examples of preferred hydroxyketones include 3-hydroxy-2-propanone, 3-hydroxy-2-butanone, dihydroxyacetone. Examples of suitable Strecker aldehyde include acetaldehyde, propanal, 2-methylpropanal, butanal, 2-methylbutanal, 3-methylbutanal, pyruvic aldehyde, hexanal, benzaldehyde and phenylacetaldehyde.

The mixture of hydroxyketone, Strecker aldehyde, and ammonium hydroxide is preferably subjected to heat treatment at a temperature of at least about 75° C. for a period of time sufficiently long so as to provide a composition containing flavorful and aromatic substances, for example from about 5 min. to about 60 min. Although treatment times and temperatures employed in the invention can be widely varied, it is preferable that the mixture is not exposed to such a high temperature for a sufficiently long period of time so as to provide a composition that exhibits a burnt, tarry, overly bitter or highly metallic flavor. Advantageously, the heat treatment is at a temperature of not more than about 150° C.

In a preferred embodiment, the heat treatment of the mixture is conducted in a closed system under pressure. A pressure controlled environment is provided by a pressure chamber or vessel which provides, during heat treatment, containment of the components of the mixture as well as the resultant flavorful and aromatic substances. Heat treatment is preferably conducted at a pressure range of from about 10 psig to about 1,000 psig, normally from about 20 psig to about 500 psig.

The composition, i.e., produced by the method of the invention after heat treatment, contains flavorful and aromatic substances including pyrazines, especially pyrazines having branched alkyl side chains, which exhibit relatively low volatility and potent flavors. The flavorful and aromatic substances are useful as casing or top dressing components for tobacco laminae and cut filler, as well as for other smokable materials. The flavorful and aromatic substances are also useful in those types of smoking articles described in U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh et al.; as well as European Patent Publication Nos. 212,234 and 277,519.

The flavorful and aromatic substances are further useful as cigarette filter additives. For example, the flavorful and aromatic compositions can be incorporated into low-density polyethylene and formed into strands, and then incorporated into cigarette filters as described in U.S. Pat. No. 4,281,671 to Bynre et al. and U.S. Pat. No. 4,826,905 to Green, Jr. et al. The flavorful and aromatic compositions also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

The method of this invention can generate a significantly high yield of flavorants including pyrazines. In addition, because more pyrazines with branched alkyl side chains are produced, the aromatic flavorants generated in the method of this invention have relatively low volatility and high flavor potency. Thus, smaller amounts of the composition resulting from the heat treatment method of the invention can be applied to a smoking article as compared to typical conventional flavorants, and smoking articles with improved flavor and aroma can be made with the aromatic flavorants. In addition, the loss of flavorants and aroma materials during the manufacturing process and storage of smoking articles is reduced, and the smoking articles can have more consistent and uniform flavorful and aromatic characters.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

BRIEF DESCRIPTION OF THE FIGURES

FIG. 1 is a graph illustrating the relationship between the total amount of pyrazines produced in a comparative heat treatment method conducted on a mixture containing high fructose corn syrup (HFCS), aldehyde and ammonium hydroxide, and the types and amount of aldehyde used in the mixture;

FIG. 2 is a graph illustrating the relationship between the percentage of branched alkyl chain pyrazines produced in a comparative heat treatment method conducted on a mixture containing HFCS, aldehyde and ammonium hydroxide, and the types and amount of aldehyde used in the mixture;

FIG. 3 is a graph illustrating the pyrazine yield resulting from heat treatment of one preferred method of the present invention conducted on a mixture containing 3-hydroxy-2-propanone, aldehyde, and ammonium hydroxide, as a function of the type and amount of aldehyde used in the mixture;

FIG. 4 is a graph illustrating the proportion of pyrazines having branched alkyl side chains resulting from heat treatment method according to the present invention of a mixture containing 3-hydroxy-2-propanone, aldehyde, and ammonium hydroxide, as a function of the type and amount of aldehyde used in the mixture;

FIG. 5 is a graph illustrating the significantly higher pyrazine yield as well as much greater proportions of branched side chain pyrazines by the method of the present invention as compared to a comparative method based on the use of HFCS in place of the hydroxyketone component used in the present invention.

FIG. 6 is a graph illustrating the effect of amino acids on the production of pyrazines and branched alkyl chain pyrazines in the method of the invention;

FIG. 7 is a graph illustrating the pyrazine yield and the percentage of pyrazines with branched alkyl side chains produced in the heat treatment of a mixture having ammonium hydroxide, isovaleraldehyde, and varying amount of HFCS and 3-hydroxy-2-propanone;

FIG. 8 is a graph illustrating the total pyrazine yield and percentage of branched side chain pyrazines produced by heat treatment of a mixture having 0.028 mole of 3-hydroxy-2-propanone, 0.028 mole of ammonium hydroxide, and 50 $\mu$l of isovaleraldehyde at different temperatures and for different time periods;

FIG. 9 is a graph illustrating the total pyrazine yield and percentage of branched side chain pyrazines produced by heat treatment of a mixture having 0.028 mole of 3-hydroxy-2-propanone, 0.014 mole of ammonium hydroxide, and a varying amount of isovaleraldehyde 105° C. for 60 minutes.

DETAILED DESCRIPTION OF THE INVENTION

In accordance with the present invention, a mixture containing a hydroxyketone, an aldehyde, and ammonium hydroxide is subjected to heat treatment for a time and under conditions sufficient to provide a composition comprising flavorful and aromatic substances.

Hydroxyketones are those organic compounds having one or more hydroxyl groups and one or more carbonyl groups in which the carbon of each carbonyl group is linked to two carbon atoms but not a hydrogen atom. It is noted that the term "hydroxyketone" as used herein is to be distinguished from "sugars" and "reducing sugars", which in their common usage denote monosaccharides such as glucose, fructose, mannose, galactose, and the like. Preferably, the hydroxyketones used have a formula of

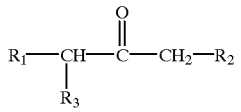

where $R_1$ is H, aryl, or an alkyl group with 1 to 3 carbon atoms, $R_2$ is H, hydroxy, aryl or an alkyl group with 1 to 3 carbon atoms, and the aryl and alkyl groups of $R_1$ and $R_2$ can have hydroxy group substituents, $R_3$ is H or hydroxy, and $R_1$, $R_2$ and $R_3$ together include 1 to 3 hydroxy groups in total. Suitable hydroxyketones for use in the present invention include, but are not limited to, 3-hydroxy-2-propanone, 3-hydroxy-2-butanone, dihydroxyacetone, pyruvic aldehyde, benzaldehyde, phenylacetaldehyde. One or a plurality of hydroxyketones can be included in the mixture. Preferably, the hydroxyketone(s) used have no more than four carbon atoms and are free of substituents other than hydroxy and carbonyl groups.

The aldehydes used can have a straight or branched hydrocarbon chain containing a terminal aldehyde moiety. They can be represented by the formula of $R_4CHO$, where $R_4$ represents alkyl with 1 to 5 carbon atoms or an aryl group, and the alkyl and aryl groups can have 3 or less hydroxy substituents. Although other aldehydes are also useful in the present invention, Strecker aldehydes are preferred. As is known in the art, Strecker aldehydes are those aldehydes that can be obtained by Strecker degradation, i.e., the reaction of an α-amino acid with a carbonyl compound or an inorganic oxidizing agent. Typically, the Strecker aldehyde produced in Strecker degradation has one less carbon atom than the amino acid has. Examples of suitable aldehydes include, but are not limited to, acetaldehyde, propanal, 2-methylpropanal, butanal, 2-methylbutanal, 3-methylbutanal, and pyruvic aldehyde.

The mixture also includes a nitrogen source. Examples of suitable nitrogen sources include ammonium hydroxide and ammonium salts such as diammonium phosphate. Ammonium hydroxide is typically used as it facilitates the creation and maintenance of a desirable pH of at least about 7. In addition, ammonium hydroxide provides nitrogen without bringing any undesirable chemical elements into the mixture.

In the mixture, the content of the total hydroxyketone(s) can be from about 5% to about 50% by weight, preferably from about 10% to about 25% by weight based on the total weight of the mixture. The mixture can have an aldehyde content of from about 0.01% to about 10%, preferably from about 0.05% to about 1% by weight based on the total weight of the mixture. Advantageously, the mixture contains from about 0.1% to about 0.2% by weight of aldehyde(s). The ammonium hydroxide (in a 30% solution) content in the mixture can range from 6% to about 60%, preferably from about 10% to about 30% by weight based on the total weight of the mixture.

The mixture can be in either a solid or liquid state. Preferably, the mixture is dissolved in a liquid solvent prior to heat treatment. The solvent can be an aqueous solvent, i.e. water, or an organic solvent such as a polyhydric alcohol. Polyhydric alcohols are useful especially when a hydroxyketone having a low water solubility is used. Suitable polyhydric alcohols include, but are not limited to, propylene glycol, glycerine, ethylene glycol, 1,3-butylene glycol, and the like. Typically, the mixture is dissolved in a liquid having an aqueous character to form a solution. Such a liquid consists primarily of water, normally greater than about 90 weight percent water, and can be essentially pure water. For example, a solvent having an aqueous character can be distilled water, tap water, or the like. Preferably a 1:1 to 4:1 ratio of liquid to mixture is preferred in forming the solution. When the mixture is dissolved in an aqueous solution, the pH of the solution is typically greater than about 5, preferably at least about 7. Typically when ammonium hydroxide is used in the mixture, the pH is greater than 7 and pH adjustment is obviated.

Other materials may also be included in the mixture such as conventional casing ingredients commonly used in the art including amino acids, licorice, coca, and sugars.

The mixture, or solution thereof, including hydroxyketone, aldehyde, and ammonium hydroxide is subjected to moderately high temperature treatment. Typically, such treatment involves exposing the mixture or a solution thereof to a temperature above about 75° C. However, it is preferred that the mixture is not subjected to a temperature that is too high in order to avoid an undesirable formation of components which are deleterious to the taste characteristics of the flavorful and aromatic composition. Normally, it is desirable to subject the mixture to a temperature of below about 200° C. Preferably, the temperature in the heat treatment is from about 75° C. to about 150° C., more preferably from about 90° C. to about 120° C.

The moderately high temperature treatment of the mixture can be performed under an inert atmosphere. For example, nitrogen or argon gas can be employed in order to provide an inert atmosphere. However, the heat treatment can be conducted under ambient atmosphere (i.e., air) as well.

The moderately high temperature treatment is preferably performed in a pressure-controlled environment. Such an environment is provided by enclosing the mixture in an air sealed vessel or chamber. Typically, a pressure-controlled environment is provided using a pressure vessel or chamber which is capable of withstanding relatively high pressures. Such vessels or chambers provide enclosure or concealment of the mixture such that the components in the mixture are contained within the vessel and any volatile flavor components generated are not lost or do not otherwise escape during the moderately high temperature treatment step. Preferred pressure vessels are equipped with an external heating source. Examples of vessels which provide a pressure controlled environment include a high pressure autoclave from Berghof/America Inc. of Concord, Calif. and a Parr Reactor Model No. 4522 and a Parr Reactor Model No. 4552 available from The Parr Instrument Co., as well as CEM Corporation Model XP-1500 and HP-500 pressure vessels. Operation of such exemplary vessels will be apparent to the skilled artisan. Typical pressures experienced by the mixture during the process of the present invention range from about 10 psig to about 1,000 psig, normally from about 20 psig to about 500 psig. Pressures experienced by the mixture typically do not exceed 100 psig during the process of the present invention.

The amount of time that the mixture is subjected to the moderately high temperature treatment can vary. Typically, when the temperature is higher, the time period is shorter. Conversely, when a lower temperature is used in the heat treatment, the length of time can be longer. Normally, the time period is sufficient to heat the mixture at the desired temperature for a period of at least about 10 minutes, preferably at least about 20 minutes, more preferably at least about 30 minutes. Normally, the time period is less than about 3 hours, preferably less than about 1 hour. However, it is desirable to control the time/temperature profile of the mixture subjected to heat treatment so that the mixture is not subjected to a particularly high temperature for a lengthy period of time. It is highly desirable to employ a pressure vessel design or a vessel equipped with an agitation mechanism such that the mixture experiences a relatively uniform temperature throughout the treatment period. In particular, it is highly desirable for the mixture to be heated uniformly throughout as much as possible at the maximum temperature to which the mixture is subjected.

The heat treatment of the mixture in the present invention results in a composition including highly desirable flavorful and aromatic substances, and particularly flavorful and aromatic substances similar to and complementing those found in smokable materials. Normally, the composition of flavorful and aromatic substances contains various types of pyrazines, and the pyrazine yield is significantly high. In addition, the proportion of pyrazines with branched side chains is particularly great. Examples of such pyrazines include, but are not limited to, 2-methylpropylpyrazine, 2-methylbutylpyrazine, cis-2-propenylpyrazine, trans-2-propenylpyrazine, etc.

As is known in the art, generally speaking, the more complex and numerous side chains a pyrazine has, the higher odor strength and lower volatility the pyrazine exhibits. Therefore, the increased content of pyrazines having larger branched and numerous side chains significantly decreases the volatility and increases the flavor potency of the flavorant and aromatic substances. Thus, when the flavorant and aroma materials are used in smoking articles, less quantities are required and they do not diminish significantly during manufacturing and storage of the smoking articles.

The flavorful and aromatic composition can be incorporated into various components of smoking articles to provide desirable flavor and aroma properties in the smoking articles.

For example, the composition of flavorful and aromatic substances prepared in accordance with the present invention can be mixed with casing materials and applied to tobacco as a casing ingredient. As is well known in the art, casing materials are used as additives to enhance the flavors in smokable materials. In cigarette manufacturing processes, casing materials are added to tobacco leaf blends before cutting. Casing materials are usually applied as suspensions or solutions. Exemplary casing ingredients that are commonly used in the art include, e.g., sugar, humectants such as glycerine or a higher glycol, licorice, cocoa, etc. The composition of flavorful and aromatic substances of the present invention can be mixed with any of the ingredients and applied to the leaf blend by either spraying or as a dip casing, or by other processes known in the art to allow the flavorful and aromatic substances produced in the present invention to be coated onto or absorbed by the blend. Alternatively, the composition of flavorful and aromatic substances can be used as a substitute for conventional casing and applied directly to tobacco leaf blends in the same manner. That is, advantageously, the smoking article is substantially free of exogenous, i.e., added sugar or other conventional casing ingredients.

The composition of flavorful and aromatic substances can also be incorporated into smoking articles as a top dressing ingredient. As is well known in the art, top dressing is added after the tobacco blend is cut into shreds or "cut filler", to supply aroma or pleasing flavor. Top dressing is usually applied as a spray solution containing highly aromatic, perfume-like substances and a material such as a glycol to retard the evaporation of the flavorant in the cigarette or cigarette package. The composition of flavorful and aromatic substances can thus be mixed in a conventional top dressing spray solution which is then sprayed onto the tobacco shreds. The composition of flavorful and aromatic substances can also be applied to the tobacco cut filler in the same manner.

Similarly, the composition of flavorful and aromatic substances can be incorporated into, or applied onto reconstituted tobacco materials including cast reconstituted tobacco materials, and reconstituted tobacco materials formed by paper making processes. As the composition contains a significantly high content of pyrazines a great portion of which have branched side chains the composition has low volatility and high potency. Therefore, the composition is particularly suitable for use in reconstituted tobacco materials.

Smoking articles can further include a filter element such as positioned adjacent to one end of rod such that the filter element is axially aligned with the rod in an end-to-end relation. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material.

The composition of flavorful and aromatic substances can be incorporated into the cigarette filter, either in the filter plug or plug wrap, or tipping paper. For example, the composition of flavorful and aromatic substances can be incorporated into low-density polyethylene which is formed into strands, and then incorporated into cigarette filters as described in U.S. Pat. No. 4,281,671 to Bynre et al. and U.S. Pat. No. 4,826,905 to Green, Jr. et al. The composition of flavorful and aromatic substances can also be incorporated into the filter material by soaking the filter material in the liquid composition of flavorful and aromatic substances or by spraying the composition in liquid solution onto the filter material during the process of making the filter. The filter material can be a conventional cigarette filter material such as cellulose acetate, polypropylene, or the like, and the filter element can have a fibrous character, a molded shape, or other such configuration.

In like manners, the composition of flavorful and aromatic substances can also be applied onto cigarette wrapping paper, preferably on the inside surface, during the cigarette manufacturing process.

The composition of flavorful and aromatic substances can also be used in a similar manner in many types of smoking articles other than the currently widely available cigarette constructions. For example, tobacco cut filler having the flavorful and aromatic substances therein may be combined with aerosol forming materials, and employed in the manufacture of those smoking articles described in U.S. Pat. No. 4,708,151 to Shelar; U.S. Pat. No. 4,771,795 to White et al.; U.S. Pat. No. 4,714,082 to Banerjee et al.; U.S. Pat. No. 4,756,318 to Clearman et al.; and U.S. Pat. No. 4,793,365 to Sensabaugh et al., as well as European Patent Publication Nos. 212,234 and 277,519, the disclosures of which are incorporated herein by reference. In addition, the tobacco cut filler containing flavorful and aromatic substances can be incorporated into those smoking articles described in U.S. Pat. No. 5,074,321 and European Patent Publication No. 280,990.

The amount of flavorful and aromatic composition employed per cigarette can vary. For example, in a typical cigarette having about 0.6 to about 1 g/rod of smokable materials, about 1 to about $10^5$ ppm of the composition based on the total weight of the smokable materials in the cigarette can be used. Generally up to 5% of the composition by dry weight, based on the dry weight of tobacco materials, can be used in the cigarette.

When smoking articles incorporating the flavorful and aromatic substances are used, i.e., smoked, the flavorful and aromatic substances exhibit an aroma that can be characterized as pleasant, clean, sweet, floral, woody, musk-like, toasty, coffee-like, chocolate-like and fruity. The aroma provided by the composition is such that the characteristic sidestream cigarette smoke aroma is masked or overridden by those components. As such the flavorful and aromatic composition provides for a reduction in the negative attributes associated with the aroma of mainstream smoke.

The following examples are provided in order to further illustrate preferred aspects of the invention but should not be construed as limiting the scope thereof.

In the following examples, unless otherwise specified, a mixture for heat treatment was prepared by mixing 0.028 moles of 3-hydroxy-2-propanone, 0.028 moles of $NH_4OH$ (30% aqueous ammonium hydroxide used), and either a selected amount of amino acid ranging from 0.5 to 2.0 g or a selected aldehyde ranging from 25 to 200 $\mu$L in volume. The final volume of the reaction mixture was adjusted to 15 mL with water. When examining the influence of the presence of HFCS versus the presence of hydroxyketones in the formulation, the amount of water was adjusted to maintain a final reaction mixture volume of 15 mL. By doing so, the concentration of reactants/reactant mole ratios was held constant throughout the entire group of experiments. The mole of HFCS refers to the mole of fructose in the HFCS sample.

Pyruvic aldehyde, 3-hydroxy-2-propanone, 3-hydroxy-2-butanone, dihydroxyacetone, and the amino acids were obtained from Aldrich Chemical Company and used as received. HFCS was obtained from Corn Products International Inc.

For heat treatment, each mixture was enclosed in a microwave permeable reaction vessel, CEM Corporation, Model #XP-1500 or HP-500. Heat treatment was conducted in a microwave oven of CEM Corporation, Model MES-1000 under the conditions described in Table I.

TABLE I

| Microwave Oven Operating Parameters | |
|---|---|
| System | CEM Model MBS-1000 |
| Sample Temperature | 75–150° C. |
| Sample Temperature Ramp Time | 10 min |
| Microwave power | 950 ± 50 watts |
| Microwave Frequency | 2450 MHz |
| Sample Heating Time | 15–60 min |
| Ramp Time to Heating Temperature | 10 min |

After heat treatment, headspace analysis was conducted in a method similar to that reported in Coleman et al., *J. Chrom. Sci.* 32:323 (1994). For each sample 1.0 mL was placed in a 5 mL sparge tube along with 1 mL of an aqueous standard containing 21.8 mg/L cyclohexanone as an internal standard. The yield of volatiles was calculated based on the response of cyclohexanone. The headspace sampling parameters listed in Table II below were applied in the analysis of each sample.

TABLE II

| Headspace-GC-MDS Operating Conditions | |
|---|---|
| System Configuration | Hewlett Packard (HP) 5800 GC equipped with a 5970 MSD and a Tekmar 2000LSC Autosampler |
| Column | DB-1701, 30 meters, 0.32 mm I.D. 1 μm film Thickness |
| Injection Port temperature | 250° C. |
| Injection | Splitless |
| Inlet Pressure | ~20 psi |
| Column Oven Initial Temperature | 10° C. |
| Column Oven Initial Time | 0 min |
| Column Oven Initial Ramp 1 Rate | 2.5° C./min |
| Column Oven 1 Final Temperature | 47° C. |
| Column Oven Ramp 2 Rate | 10° C./min |
| Column Oven 2 Final Temperature | 230° C. |
| Column Oven 2 Final Time | 20 min |
| Sample Purge Time | 20 min |
| Sample Pre-heat Time | 5 min |
| Sample Desorb Time | 5 min |
| Sample Desorb Temperature | 180° C. |
| Sample Purge Temperature | 70° C. |
| Mass Spectrometer Transfer Line Temp | 250° C. |
| Mass Spectrometer Configuration | Electron Impact, 70 eV |

COMPARATIVE EXAMPLE I

Heat Treatment Of A Mixture Of Sugar, Aldehyde, And Ammonium Hydroxide

Mixtures containing HFCS, ammonium hydroxide, and different types of aldehyde at different amount were prepared by mixing 0.028 moles of HFCS, 0.028 moles of $NH_4OH$ (30% aqueous ammonium hydroxide used), and a selected aldehyde ranging from 0 to 200 μL in volume. The final volume of the reaction mixture was adjusted to 15 mL with water. Each mixture was heated in a microwave oven as described at 105° C. for 60 minutes. The relationships between the amount of pyrazines produced and the percentage of branched pyrazines as a function of the types and amount of aldehyde used are displayed in FIGS. 1 and 2.

EXAMPLE I

Heat Treatment of Mixtures Containing 3-OH-2-Propanone, an Aldehyde, and Ammonium Hydroxide A series of formulations containing 3-hydroxy-2-propanone, $NH_4OH$, and an aldehyde were prepared as described. Several different types of aldehyde were tested at different amounts. The mixtures were heat-treated in the microwave oven at 105° C. for 60 minutes. The headspace above these formulations were measured and the results are presented in FIGS. 3 and 4.

As is apparent from Example I and Comparative Example I, with a set amount of a specific type of aldehyde, when hydroxyketone 3-hydroxy-2-propanone was used as opposed to HFCS (which contains primarily reducing sugars and is generally used in the art as a reducing sugar source), the yield of pyrazines was significantly higher. (Compare FIG. 3 to FIG. 1.) In addition, the percentage of pyrazines having branched side chains was dramatically increased. (Compare FIG. 4 to FIG. 2.) Indeed, the percentage of branched side chain pyrazines in the former reached as high as about 35% while that in the latter was at maximum about 8%.

In addition, as is clear from FIGS. 1–4, within the amount range tested, increase in the amount of aldehyde typically leads to the increase of both the total yield of pyrazines and the percentage of pyrazines with branched side chains.

Among the dominant branched alkyl side chain pyrazines found in the composition resulted from the heat treatment were 3-methylbutylpyrazines, 2-methylbutylpyrazines and 2-methylpropylpyrazines corresponding to the use of isovaleraldehyde, isobutyraldehyde and 2-methylbutanal respectively. Additionally, other types of branched alkyl side chain pyrazines such as cis- and trans-propenylprazines were also noted in these particular compositions.

EXAMPLE 1A

Comparison Between HFCS, 3-OH-2-Propanone, and Dihydroxyacetone

Three mixtures were prepared containing 200 μl of isovaleraldehyde, 0.028 mole of ammonium hydroxide, and 0.028 mole of HFCS, 3-hydroxy-2-propanone or hydroxyacetone. The total volume was brought to 15 ml with water. The heat treatment was conducted as described at 105° C. for 60 minutes. The pyrazine yield and the percentage of pyrazines having branched side chains produced in each mixture are shown in FIG. 5.

As indicated in FIG. 5, both types of hydroxyketone, namely 3-hydroxy-2-propanone and dihydroxyketone, leads to significantly higher pyrazine yield as well as much greater proportions of branched side chain pyrazines, as compared to HFCS. Although the increase in percentage of branched alkyl side chain pyrazines in the dihydroxyacetone-containing formulation was not as significant as that observed with 3-OH-2-propanone, but none the less was significantly greater than that found for the HFCS case.

EXAMPLE 2

The Effect Of Amino Acids

A series of formulations were prepared as described above employing selected amino acids at a constant concentration, in admixture with ammonium hydroxide, and HFCS or 3-OH-2-propanone as "carbon" source. Heat treatment was conducted as described above. The results are illustrated in FIG. 6.

Based on the results in FIG. 6 and the comparison of the results in FIGS. 1–6, at least the following conclusions can be drawn. First, regardless of the amino acid employed, when hydroxyketone 3-hydroxy-2-propanone was used as opposed to HFCS, both the yield of pyrazines and the percentage of branched side chain pyrazines were consistently much higher.

Second, as compared to heating a mixture of just 3-hydroxy-2-propanone and ammonium hydroxide alone, the addition of amino acids in general increases the yield of pyrazines and branched alkyl side chain pyrazines. (Compare FIG. 6 to FIG. 3.) Nevertheless, compared to their comparable Strecker aldehydes, amino acids were much less effective (on a mole to mole basis) in producing branched alkyl side chain pyrazines. (Compare FIG. 6 to FIG. 4.) While not wishing to be bound by any theory, it is believed that this is because amino acids generally undergo Strecker degradations during the heat treatment to form Strecker aldehydes which are then employed in the formation of branched alkyl side chain pyrazines. Therefore, the use of Strecker aldehydes eliminates the need for an intermediate Strecker degradation reaction and increases the efficiency in the formation of pyrazines.

EXAMPLE 3

The Combination Of HFCS And Hydroxyketone

Based on the performance of 3-OH-2-propanone and dihydroxyacetone as "carbon" sources for pyrazine synthesis, the combination of these new carbon sources with HFCS was investigated. Therefore, an array of formulations were blended as described. These mixtures all have the same total combined amount of HFCS and 3-OH-2-propanone (0.028 mole), but different proportions of 3-OH-2-propanone. The proportion amount of 3-OH-2-propanone was increased stepwise in exchange for fructose on a mole for mole basis from 0 to 100%. The experimental results are plotted in FIG. 7.

As can be seen from FIG. 7, as the proportion of 3-OH-2-propanone increased, both the yield of pyrazines and the percentage of branched alkyl side chain pyrazines increased. Thus, flexibility in the design of novel cooked casings can now be possible through variations in the amount of 3-OH-2-propanone employed.

EXAMPLE 4

The Effect of Reaction Time and Reaction Temperature

A series of mixtures containing 3-hydroxy-2-propanone, isovaleraldehyde, and ammonium hydroxide were prepared as described. The mixtures were heat treated in a manner as described above at different temperatures and for various periods of time. The results are shown in FIG. 8.

Both the pyrazine yield and percentage of branched alkyl side chain pyrazines increased significantly with reaction time and temperature. Although the total pyrazine yield at 105° C. increased significantly when the time of heat treatment was increased from 15 minutes to 60 minutes, the percentage of branched alkyl side chain pyrazines decreased somewhat.

EXAMPLE 5

The Effect of Ammonium Hydroxide

A series of mixtures were prepared containing 0.014 mole of ammonium hydroxide, 0.028 mole of 3-hydroxy-2-propanone, and a varying amount of isovaleraldehyde. The mixtures were heat treated at 105° C. for 60 minutes. The results are shown in FIG. 9.

Although the foregoing invention has been described in some detail by way of illustration and example for purposes of clarity of understanding, it will be obvious that certain changes and modifications may be practiced within the scope of the appended claims.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

That which is claimed:

1. A method for providing flavorful and aromatic substances for use in a smoking article, comprising:

providing a mixture including a hydroxyketone, an aldehyde, and ammonium hydroxide; and subjecting said mixture to heat treatment for a time and under conditions sufficient to provide a flavorful and aromatic composition.

2. The method of claim 1, wherein the hydroxyketone has a formula of

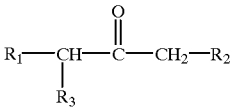

where $R_1$ is H, aryl, or an alkyl group having 1 to 3 carbon atoms;

$R_2$ is H, hydroxy, aryl, or an alkyl group having 1 to 3 carbon atoms, and $R_1$ and $R_2$ optionally have hydroxy group substituents;

$R_3$ is H or hydroxy; and $R_1$, $R_2$ and $R_3$ together include 1 to 3 hydroxy groups in total.

3. The method of claim 1, wherein the hydroxyketone is selected from the group consisting of 3-hydroxy-2-propanone, 3-hydroxy-2-butanone, and dihydroxyacetone.

4. The method of claim 1, wherein said hydroxyketone is 3-hydroxy-2-propanone.

5. The method of claim 1, wherein said hydroxyketone is dihydroxyacetone.

6. The method of claim 1, wherein said aldehyde is represented by the formula $R_4CHO$, where $R_4$ represents alkyl with 1 to 5 carbon atoms or an aryl group, and the alkyl group or aryl group optionally has 3 or less hydroxy substituents.

7. The method of claim 1, wherein the aldehyde is a Strecker aldehyde.

8. The method of claim 1, wherein the aldehyde is selected from the group consisting of acetaldehyde, propanal, 2-methylpropanal, butanal, 2-methylbutanal, 3-methylbutanal, and pyruvic aldehyde.

9. The method of claim 1, wherein said aldehyde is 2-methylpropanal.

10. The method of claim 1, wherein said aldehyde is 3-methylbutanal.

11. The method of claim 1, wherein said aldehyde is 2-methylbutanal.

12. The method of claim 1, wherein said mixture comprises from about 5 to about 50 percent by weight of hydroxyketone based on the total weight of the mixture.

13. The method of claim 1, wherein said step of heat treatment is conducted at a temperature of from about 75° C. to about 150° C.

14. The method of claim 1, wherein said step of heat treatment is conducted at a temperature of from about 90° C. to about 110° C.

15. The method of claim 1 further comprising dissolving said mixture in water to form an aqueous solution prior to said heat treatment.

16. The method of claim 1 further comprising dissolving said mixture in a polyhydric alcohol prior to said heat treatment.

17. A method for providing flavorful and aromatic substances for use in a smoking article, comprising the steps of:

providing an aqueous solution containing ammonium hydroxide, a hydroxyketone selected from the group consisting of 3-hydroxy-2-propanone and dihydroxyacetone, and a Strecker aldehyde selected from the group consisting of 2-methylpropanal, butanal, 2-methylbutanal and 3-methylbutanal; and subjecting the aqueous solution to heat treatment at a temperature of from about 90° C. to about 110° C. at a pressure of about 10 to about 100 psi to provide a flavorful and aromatic composition.

18. A method for improving the flavor and aroma properties in a smoking article comprising:

providing a mixture including a hydroxyketone, a Strecker aldehyde, and ammonium hydroxide;

subjecting said mixture to heat treatment for a time and under conditions sufficient to provide a flavorful and aromatic composition; and applying said composition to at least one component of said smoking article.

19. The method of claim 18, wherein the hydroxyketone is selected from the group consisting of 3-hydroxy-2-propanone, 3-hydroxy-2-butanone, and dihydroxyacetone.

20. The method of claim 18, wherein said aldehyde is selected from the group consisting of acetaldehyde, propanal, 2-methylpropanal, butanal, 2-methylbutanal, 3-methylbutanal, and pyruvic aldehyde.

* * * * *